US005501466A

United States Patent [19]

Welch et al.

[11] Patent Number: 5,501,466

[45] Date of Patent: Mar. 26, 1996

[54] COIN PROJECTING GAME APPARATUS

[75] Inventors: Wallace W. Welch, Downers Grove; Python V. Anghelo, Chicago; William F. Triplett, Elgin, all of Ill.; Katherine A. Adams, Chesterton, Ind.

[73] Assignee: Capcom Coin-op, Inc., Arlington Heights, Ill.

[21] Appl. No.: 387,021

[22] Filed: Feb. 10, 1995

[51] Int. Cl.[6] ..... A63F 9/02

[52] U.S. Cl. ..... 273/355; 273/356; 273/371; 273/394; 273/405; 273/407; 273/138 A

[58] Field of Search ..... 273/355, 356, 273/371, 394, 425, 407, 138

[56] References Cited

U.S. PATENT DOCUMENTS

| | | | |
|---|---|---|---|
| 4,496,160 | 1/1985 | Wichinsky et al. | 273/369 |
| 4,662,636 | 5/1987 | Crompton | 273/138 A |
| 4,744,566 | 5/1988 | Malavazos et al. | 273/138 A X |
| 4,759,551 | 7/1988 | Crompton | 273/355 |
| 4,844,464 | 7/1989 | Berge | 273/355 X |
| 5,016,880 | 5/1991 | Berge | 273/355 X |
| 5,275,402 | 1/1994 | Malavazos et al. | 273/138 A |
| 5,292,127 | 3/1994 | Kelly et al. | 273/138 R |
| 5,297,816 | 3/1994 | Becchio | 273/138 A X |
| 5,326,108 | 7/1994 | Faith . | |
| 5,445,138 | 8/1995 | Faith . | |

*Primary Examiner*—Raleigh W. Chiu
*Attorney, Agent, or Firm*—Robert E. Browne; Gary R. Jarosik

[57] ABSTRACT

A game apparatus is provided comprising a cabinet defining a playing area including a plurality of shelves mounted therein where each of the shelves has disposed thereon a plurality of game pieces. A receiving mechanism is attached to the cabinet for accepting a playing piece. A player aimable, launching mechanism is linked to the receiving mechanism for launching the playing piece towards the aimed at location for the purpose of dislodging some of the game pieces. A redemption mechanism may be provided for accepting any dislodged game pieces to provide a reward in exchange therefor.

18 Claims, 6 Drawing Sheets

COIN PROJECTING GAME APPARATUS

BACKGROUND OF THE INVENTION

This invention relates generally to amusement games and, more particularly, relates to target type skill games.

Amusement games in which coins are dropped onto a shelf traversed by pusher bars is well known. In such an arrangement the coins build up on the shelf until the constant movement of the pusher bar causes coins to fall off a forward edge of the shelf as a reward. A further known device is a game apparatus comprising a cabinet defining a playing area, means for receiving a playing piece such as a token or the like, means for projecting an accepted playing piece within the playing area, and a sensor, disposed within the playing area, which may be triggered by a projected playing piece. The sensor, when actuated by contact, causes the apparatus to register a predetermined reward. The device further includes a lower shelf surface onto which the playing pieces may fall after projection which includes a pusher for pushing the collected playing pieces from the shelf. The latter device may be seen in U.S. Pat. No. 4,496,160 to Wichinsky et al.

While these devices work for their intended purpose, there exists a need for a novel coin game apparatus having new skill testing features whereby renewed interest by players of redemption type games will be generated.

With this need in mind, it is an object of the present invention to provide a variation of the amusement game of the foregoing type in which catapulted coins will be used as the mechanism for causing playing pieces to cascade downward from shelf to shelf to an ultimate redemption area.

It is a further object of the present invention to provide a mechanism whereby the operator of the amusement game may modify the arc and strength of the catapult used to launch the coins for adjusting play of the game.

It is another object of the present invention to provide a mechanism whereby the operator of the amusement game may modify the pitch of the shelves for further adjusting play of the game.

It is yet another object of the present invention to provide the player with the ability to load the device with multiple coins.

It is still another object of the present invention to provide a game cabinet which is resistant to user abuse and prevents the user from shaking coins free from the shelves within the playing area.

SUMMARY OF THE INVENTION

In accordance with these objects, a game apparatus is provided comprising a cabinet defining a playing area including a plurality of shelves mounted therein where each of the shelves has disposed thereon a plurality of game pieces. A receiving mechanism is attached to the cabinet for accepting a playing piece. An aimable launching mechanism is linked to the receiving mechanism for launching the playing piece towards any aimed at shelf for the purpose of dislodging some of the game pieces. A redemption mechanism accepts any dislodged game pieces and provides a reward in exchange therefor.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the inventions contained herein can be used in all types of amusement games it will be described hereinafter in the context of a coin projecting game apparatus as the preferred embodiment thereof.

Figure 1:
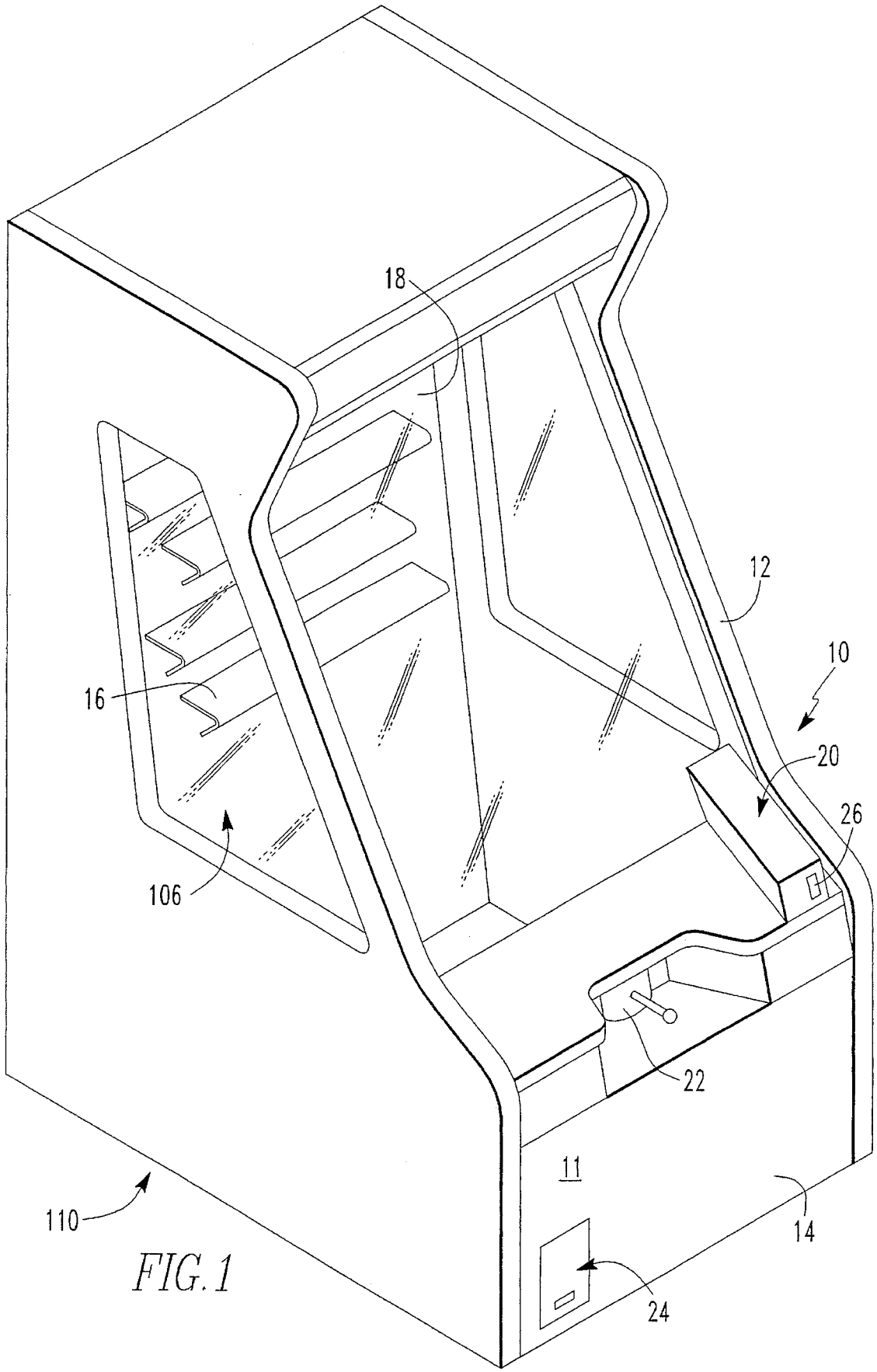
FIG. 1 is a perspective view of the game apparatus which is the subject of the present invention.

Referring now to the figures, wherein like reference numerals refer to like elements, a game apparatus 10 is shown generally in FIG. 1. Game apparatus 10 generally comprises a cabinet 11 defining an upper portion 12 and a lower portion 14. The upper portion 12 includes a plurality of fixed shelves 16 projecting from the rear 18 of the cabinet. The lower portion 14 of the cabinet houses the coin accepting apparatus 20, the coin catapult 22, and the coin redemption mechanism 24.

Figure 2:
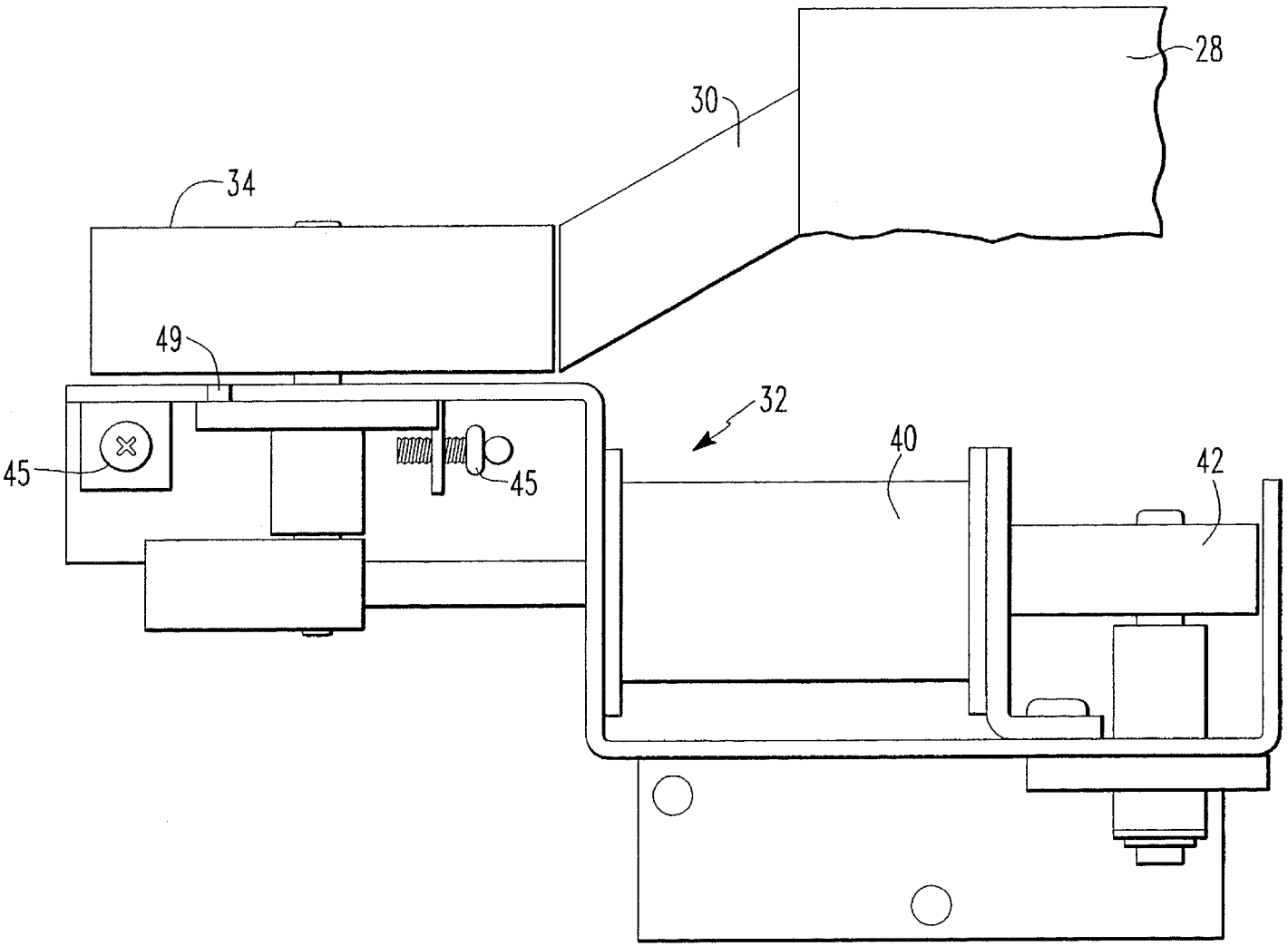
FIG. 2 is a side view of the coin accepting and moving apparatus used in conjunction with the present invention.

The game apparatus 10 is coin-operated and the cabinet 11 includes a coin slot 26 leading to a conventional mechanical coin detector 28, shown in FIG. 2, which detects incorrect coins by size, metal content, or weight in a known manner. The accepted coin travels to trough 30 where each accepted coin waits to be put into play. Trough 30 connects to coin moving mechanism 32 which in turn leads to the coin catapult 22.

Figure 3:
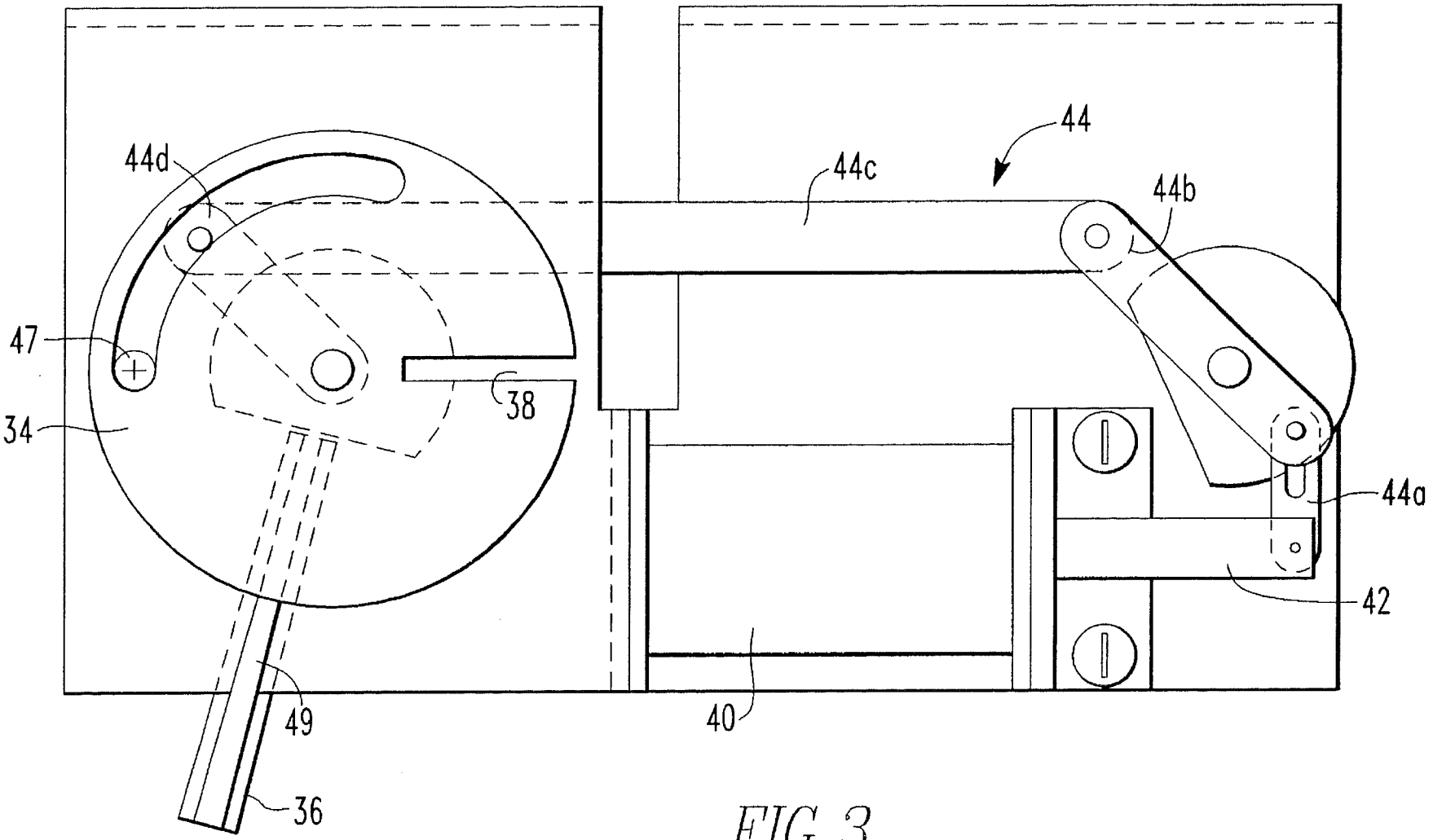
FIG. 3 is a top view of the coin accepting and moving apparatus of FIG. 2.

The coin moving mechanism 32, shown in FIGS. 2 and 3, is mounted to the cabinet and includes a rotating wheel 34 and a loading trough 36. Rotating wheel 34 has a slot 38 into which an accepted coin will fit when wheel 34 is rotated such that slot 38 aligns with the end of trough 30. This alignment preferably occurs at one extreme of the degree of rotation given to the wheel 34. At the other extreme of rotation of the wheel 34, the slot 38 aligns with loading trough 36 whereby the coin will exit the slot 38 and move theredown onto the coin catapult 22. Wheel 34 is rotatable by a solenoid 40 which includes a spring biased plunger 42 linked to the wheel 34 via link 44. Preferably link 44 is constructed to allow the wheel 34 to rotate approximately 110 degrees in response to the movement of the plunger 42 between the fully extended and fully retracted positions. Specifically, link 44 comprises a first link **44*a*, which is pivotally connected to the plunger 42, a second link 44*b*, which is rotatably mounted to the coin moving mechanism mounting bracket and pivotally linked to first link 44*a*** and to third link 44*c*, and fourth link 44d, which is fixedly connected to the wheel 34 and pivotally connected to the link 44*c*. A sheath (not shown) may be provided around wheel 34 for the purpose of helping to maintain the coin in the slot 38 as the wheel 34 is rotated between extreme positions. Furthermore, for adjusting the wheel 34 to ensure proper alignment between slot 38 and troughs 30,36, the wheel 34 may be provided with adjustment screws 45 attached to the securing bracket and a blocker 47 attached to the wheel 34 through the securing bracket and engageable with each screw 45. The screws 45 are adjustable and are positioned so as to stop rotation of the wheel 34 at each of the extreme rotational positions. Stoppage occurs when the blocker 47 engages the screw 45 positioned adjacent thereto.

During operation of the coin moving mechanism 32, a switch (not shown) is activated by the player indicating that the player would like to load a coin onto the coin catapult 22. Preferably the switch is activated by placing the coin catapult 22 under the loading trough 36. Once activated, the plunger 42 of solenoid 40 is caused to be moved from the extended position, in which it is biased by a spring or the like, to the retracted position by current passing through the coils of the solenoid. The wheel 34, and the coin loaded in slot 38, is caused to rotate generally horizontally as the link 44 follows the plunger 42 until the plunger 42 has reached the totally retracted position which corresponds to the position where the slot 38 aligns with the loading trough 36. The current in the coil of the solenoid 40 is maintained long enough for the coin to fall from the slot 38, through a corresponding slot 49 in the support bracket, at which time the current is cut causing the plunger 42 to be moved to back to the biased, extended position where the wheel 34 will rotate back to the start position. Once in the start position, slot 38 will align With trough 30 and another coin will load into slot 38 which can then be similarly loaded onto the coin catapult.

Figure 4:
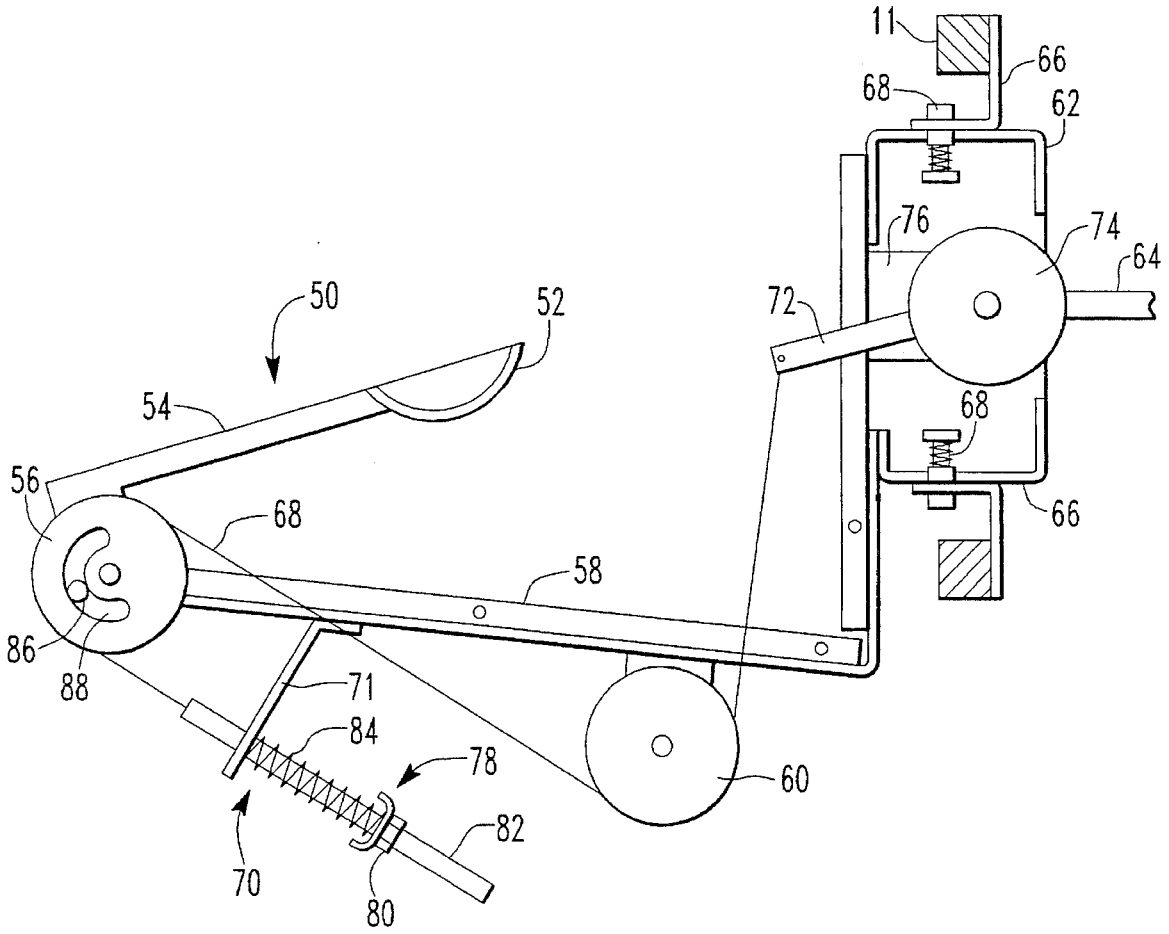
FIG. 4 is a side, sectional view of the coin catapult used in conjunction with the present invention.

The coin catapult 22, shown in FIG. 4, into which the coin or coins is deposited includes a coin launcher 50 having a basket 52. The basket 52 is adjustably linked via an arm 54 to a first drum or pulley 56 which is rotatably mounted between brackets 58. Also rotatably mounted between brackets 58 is a second drum or pulley 60. Brackets 58 are preferably mounted to a handle housing 62 from which extends a handle 64. Handle housing 62 may be pivotally attached to brackets 66 mounted to the cabinet 11 by spring loaded clasps 68 whereby the coin catapult 22 may be easily attached or removed from cabinet 11. The handle 64 extends from the housing 62 through an opening in cabinet 11 whereby the player may move the handle side to side to cause the handle housing 62 to pivot about brackets 66 to in turn align the basket 52 in the desired direction of launch. The handle 64 is further linked to the basket 52 via cable 68 such that the handle may be pulled down and released by the player to launch the coin loaded within the basket 52. Specifically, the cable 68 is attached at one end to a spring biased anchor 70, attached by bracket 71 to brackets 58, around the first and second drums 56,60 to a link 72. Link 72 is attached to a drum 74, rotatably attached between brackets 76 which are mounted to housing 62, to which in turn is attached handle 64.

During operation, as the handle 64 is pulled down, drum 74 rotates raising link 72 which in turn pulls on cable 68. As cable 68 moves against the force of spring anchor 70 drums 56,60 rotate which in turn lowers arm 54 and basket 58. When the handle 64 is released, the spring anchor 70 pulls the cable 68 in the opposite direction back to the rest position or beyond. The amount the cable 68 moves depends upon the load placed on the spring anchor 70 by the player in pulling down on handle 64. As the cable 68 returns, the movement of the cable causes the drums 56,60 to rotate which causes the arm 54 and the basket 60 to rotate forward whereby the coin is launched therefrom.

Optionally, the spring anchor 70 may be provided with a tension adjusting mechanism 78 for varying the force the spring anchor 72 will impart on cable 68 when handle 64 is released. In the illustrated embodiment, the adjusting mechanism comprises a nut 80 or the like attached to a cable anchor rod 82 such that the nut 80 is adjustable along the length of the cable anchor rod 82 to vary the compression of the spring 84 which is disposed around the anchor rod 82 between the nut 80 and bracket 71. It is known that the more compressed the spring 84 becomes the more force the spring 84 will impart on the cable 68 when the handle 64 is released which will in turn impart more force or speed to the basket 52.

Furthermore, the coin catapult 22 may be optionally provided with a mechanism for varying the arc imparted upon the coin as it is launched. In the illustrated embodiment, the position of the arm 54 with respect to the drum 56 is variable as the arm is slidably attached to the drum by bolt 86 positioned in a slot 88 in drum 56. As seen, the extreme downward and upward positions of the basket 52 are adjustable by variably positioning the attachment point within slot 88. As can be understood, by varying the position of the arm 54 with respect to the drum 56, the extreme launching angle of the launcher 50 can be controlled.

Once a coin is launched from coin catapult 22 it will be directed towards the shelves 16 on which similar coins or tokens are stacked or deposited where the object is to knock the deposited coins off the shelves 16 into the coin redemption mechanism 24. The coin redemption mechanism 24 is standard in the art and provides for a payout in either tickets or coins depending upon the number of coins which have fallen therein. Preferably, the bottom of the game play field is pitched for directing the fallen coins into the coin redemption mechanism 24.

Figure 5:
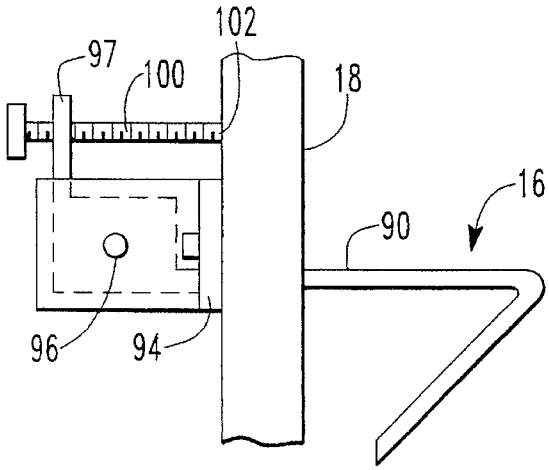
FIG. 5 is a side view of the shelf assembly used in conjunction with the present invention.
Figure 6:
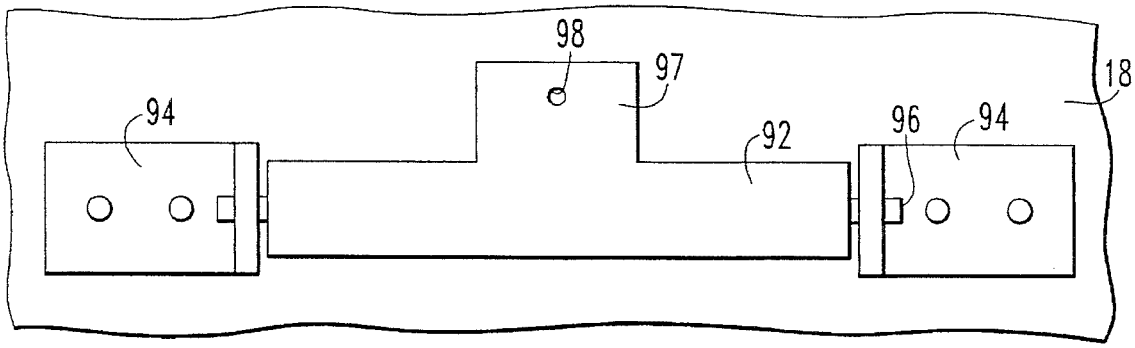
FIG. 6 is a back view of the shelf assembly of FIG. 5.
Figure 7:
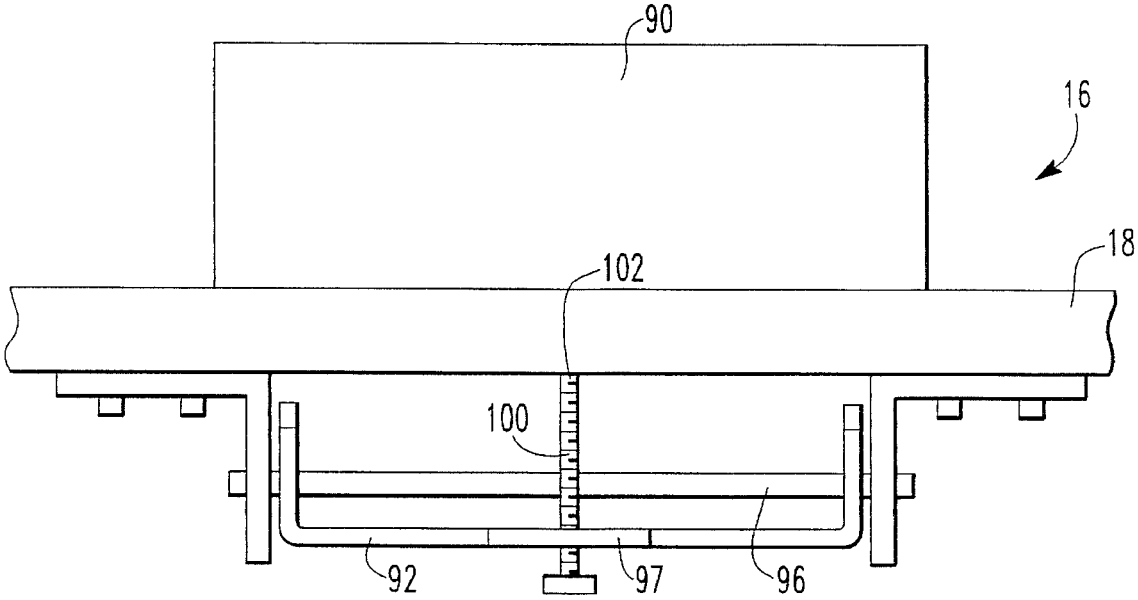
FIG. 7 is a top view of the shelf assembly of FIG. 5.
Figure 8:
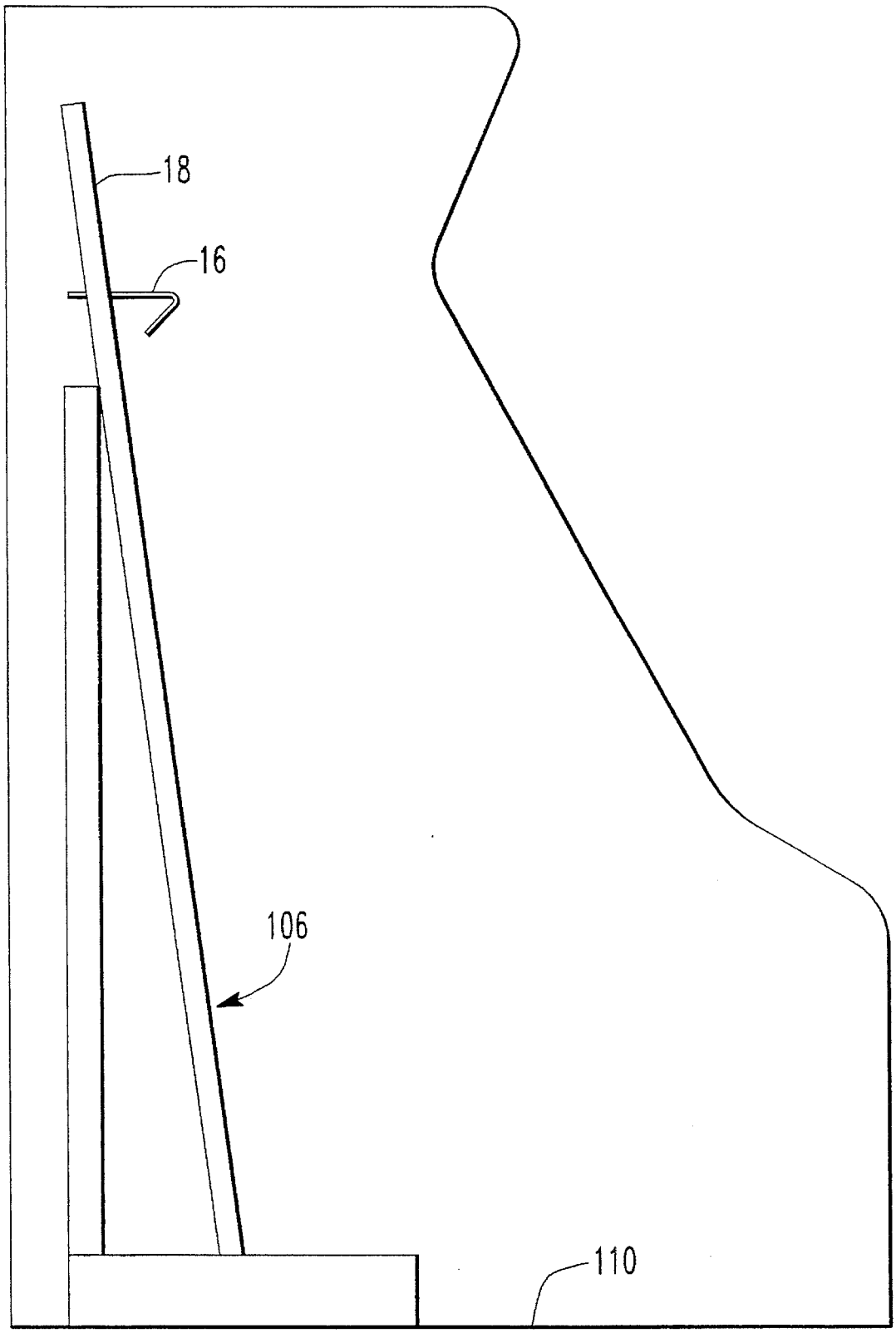
FIG. 8 is a side view of the cabinet assembly used in conjunction with the present invention.

To percentage the game, the shelves 16 may optionally be provided with an adjustment mechanism, shown in FIGS. 5–7, whereby the angle of the shelves with respect to the horizontal may be adjusted. Specifically, each shelf may comprise a ledge 90, which passes through an opening in the rear 18 of the cabinet, attached to a tray bracket 92 which is in turn pivotally mounted to the backside of rear 18 by mounting brackets 94. Specifically, the tray bracket and mounting brackets each have holes through which pivot pin 96 passes. As shown, the weight of the ledge 90 biases the ledge 90 to a downward tilting position about pivot pin 96. To allow adjustment and control over the downward bias, bracket 92 is provided with a projection 97 having a threaded opening 98 through which a threaded rod 100 passes. Threaded rod 100 has an end 102 which engages the backside of rear 18 whereby the bracket 92 is prevented from rotating further by the engagement therebetween. By varying the amount of insertion of threaded rod 100 into threaded hole 98 the angle of the ledge 90 is capable of being varied as the bracket 92 rotates about pivot pin 96.

In order to protect the machine from abuse a standard cutoff mechanism may be employed which typically consists of a movement sensing device. Consequently, if a player strikes the machine to try and induce coins to become dislodged from the shelves, the cutoff mechanism will make the machine stop all payouts. Furthermore, a cabinet design is provided whereby the back 28 to which the shelves 16 are attached exists as a sub-frame 106 within a shell of outer cabinet 110 but which is not attached thereto whereby movement of the outer cabinet 110 will not impart similar movement to the subframe 106. Specifically, the outer cabinet 110, which may include the coin accepting apparatus 20, the coin launching mechanism 22, and the coin redemption mechanism 24, is provided with a hole in its floor and in its back. Positioned to stand within the hole in the floor of cabinet 110 is sub-frame 106 such the back side of back portion 18 is exposed through the opening in the back of the outer cabinet 110 to allow access to the shelve support mounts. The sub-frame 106 and outer cabinet 110 are preferably weighted to assist in security thereof. It is contemplated that the games will be positioned with their backs against a wall or back to back making access to the sub-frame 106 next to impossible. The spacing between the sub-frame 106 and the outer cabinet 110 is required to be enough that any minimal movement of the outer cabinet 110 will not cause the two structures to contact. The game may also be provided with a latching mechanism which will secure the sub-frame 106 within the outerframe 110 for allowing transport thereof.

It should be apparent from the preceding description that this invention has among other advantages, the advantage of providing a unique skill game capable of variable play through operator adjustments.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A game apparatus, comprising:

a cabinet defining a playing area including a plurality of shelves mounted therein each having disposed thereon a plurality of game pieces;

a receiving mechanism attached to said cabinet for accepting a playing piece; and a spring activated catapult mechanism linked to said receiving mechanism for launching said playing piece towards said shelves for the purpose of dislodging said game pieces.

2. The game apparatus of claim 1, wherein each of said plurality of shelves is adjustable such their angle with respect to the horizontal plane may be varied.

3. The game apparatus of claim 2, further comprising a plurality of shelf mounting brackets mounted to said cabinet, wherein said plurality of shelves each comprise a ledge portion connected to a ledge bracket which is in turn pivotally connected to a corresponding one of said shelf mounting brackets, and wherein said ledge bracket includes an angle adjusting means for adjusting the angle of said ledge with respect to the horizontal.

4. The game apparatus of claim 3, wherein said angle adjusting means comprises said ledge bracket having a threaded opening and a threaded rod matable therewith, where an end of said threaded rod is engagable with said cabinet for preventing said ledge bracket from pivoting.

5. The game apparatus of claim 1, further comprising a redemption mechanism for accepting any dislodged game pieces and providing a reward in exchange therefor.

6. The game apparatus of claim 1, wherein said catapult mechanism is pivotally mounted to said cabinet.

7. The game apparatus of claim 6, wherein said catapult mechanism comprises a player activated lever, a drum, a spring anchor, and a cable connecting said lever to said spring anchor around said drum, and further wherein said drum has mounted thereto a launcher.

8. The game apparatus of claim 7, wherein said launcher comprises a basket attached to an arm, said arm being mounted on said drum.

9. The apparatus of claim 1, wherein said catapult mechanism further comprises a force adjuster for controlling the launching force imparted on said playing piece.

10. The game apparatus of claim 9, wherein said catapult mechanism comprises a lever, a spring anchor having a compression spring, and a cable connecting said spring anchor to said lever, and further wherein said force adjuster comprises a compression adjusting mechanism for varying the compression of said compression spring.

11. The apparatus of claim 1, wherein said catapult mechanism comprises an arc adjusting mechanism for limiting the angle at which said playing piece is capable of being launched.

12. The game apparatus as recited in claim 1, wherein said cabinet further comprises a free standing sub-frame to which said plurality of shelves are mounted and a shell surrounding said sub-frame.

13. The game apparatus as recited in claim 12, wherein said shell carries said player aimable, lauching mechanism.

14. A game apparatus, comprising:

a cabinet defining a playing area including a plurality of adjustable shelves mounted therein each having disposed thereon a plurality of game pieces, wherein each of said plurality of shelves is adjustable such their angle with respect to the horizontal plane may be varied;

a receiving mechanism attached to said cabinet for accepting a playing piece; and a launching mechanism linked to said receiving mechanism for launching said playing piece towards said shelves for the purpose of dislodging said game pieces.

15. A game apparatus, comprising:

a cabinet defining a playing area including a plurality of adjustable shelves mounted therein each having disposed thereon a plurality of game pieces, wherein each of said plurality of shelves is adjustable such their angle with respect to the horizontal plane may be varied;

a receiving mechanism attached to said cabinet for accepting a plurality of playing piece, said receiving mechanism comprising a first guide for moving each of said playing piece in a first directional plane, a second guide for moving each of said playing piece in second directional plane, and a link for moving said playing piece between said first and second guides;

a spring loaded catapult mechanism linked to said receiving mechanism and pivotally mounted to said game cabinet for launching any number of said plurality of playing pieces towards said shelves for the purpose of dislodging said game pieces; and a redemption mechanism for accepting any dislodged game pieces and providing a reward in exchange therefor.

16. A game apparatus, comprising:

a cabinet defining a playing area including a plurality of shelves mounted therein each having disposed thereon a plurality of game pieces;

a receiving mechanism attached to said cabinet for accepting a playing piece; and a launching mechanism linked to said receiving mechanism for launching said playing piece towards said shelves for the purpose of dislodging said game pieces;

wherein said cabinet further comprises a free standing subframe which carries said plurality of shelves and a shell which carries said launching mechanism and said receiving mechanism, said shell being disassociated from and substantially surrounding said sub-frame.

17. A game apparatus, comprising:

a cabinet defining a playing area including a plurality of shelves mounted therein each having disposed thereon a plurality of game pieces;

a receiving mechanism attached to said cabinet for accepting a coin like piece; and a launching mechanism linked to said receiving mechanism for launching said coin like piece towards said shelves for the purpose of dislodging one of said game pieces;

wherein said receiving mechanism comprises a first guide for moving said coin like piece in a first directional plane, a second guide for moving said coin like piece in a second directional plane, and a link for moving said coin like piece between said first and second guides.

18. The game apparatus of claim 17, wherein said first and second guides each comprise a trough and wherein said link comprises a wheel having a slot into which said coin like piece may fit, said wheel being rotatable between said troughs.

* * * * *